United States Patent [19]

Toole

[11] 4,248,390

[45] Feb. 3, 1981

[54] ROCK CRUSHING MACHINE WITH ROTARY ECCENTRIC JAW DRIVING MECHANISM

[76] Inventor: Nicolle A. Toole, 1235 SW. 2nd Ave., Ontario, Oreg. 97914

[21] Appl. No.: 5,726

[22] Filed: Jan. 23, 1979

[51] Int. Cl.[3] ..... B02C 1/06

[52] U.S. Cl. ..... 241/263; 241/264

[58] Field of Search ..... 241/262–269

[56] References Cited

U.S. PATENT DOCUMENTS

| | | | |
|---|---|---|---|
| 2,177,524 | 10/1939 | Gruender . | |
| 2,487,744 | 11/1949 | Waters | 241/264 |
| 2,505,132 | 4/1950 | Meinhardt | 241/267 |
| 2,588,180 | 3/1952 | Traylor, Jr. . | |
| 2,626,759 | 1/1953 | Barber et al. . | |
| 2,701,107 | 2/1955 | Johnson . | |
| 2,737,349 | 3/1956 | Hicken | 241/265 |
| 2,998,936 | 9/1961 | Gruender | 241/265 |
| 3,001,729 | 9/1961 | Conway | 241/265 |
| 3,145,938 | 8/1964 | Pollitz | 241/267 |
| 3,211,388 | 10/1965 | Gartner | 241/262 |

*Primary Examiner*—Howard N. Goldberg

*Attorney, Agent, or Firm*—Klarquist, Sparkman, Campbell, Leigh, Hall & Whinston

[57] ABSTRACT

A rock crusher includes a rotary eccentric drive mechanism for imparting substantially linear motion to a movable jaw between a pair of fixed jaws. A driven cam shaft cooperates with a surrounding eccentric sleeve to impart this motion to the jaw. In one embodiment, the movable jaw is suspended between the fixed jaws by a pivot shaft and one such drive mechanism is employed. In another embodiment, a pair of such drive mechanisms operate together and cause the crushing motion.

17 Claims, 8 Drawing Figures

ROCK CRUSHING MACHINE WITH ROTARY ECCENTRIC JAW DRIVING MECHANISM

BACKGROUND OF THE INVENTION

1. Field of the Invention

The present invention relates to rock crushers having a drive mechanism for moving a movable jaw between a pair of fixed jaws.

2. Description of the Prior Art

It is preferable in movable jaw type rock crushers to have the jaw move as nearly lineally as possible between a pair of stationary jaws. This is because the greatest crushing efficiency is achieved by linear motion of one jaw relative to the other, in contrast to orbital motion. Furthermore, because most crushing takes place between the lower ends of the movable and fixed jaws, it is particularly desirable that the motion of the jaw be substantially linear in that region.

Heretofore, drive mechanisms employing a single cam have been utilized to impart motion to the movable jaw of a crusher. However, as typified by U.S. Pat. No. 2,737,349, such mechanisms commonly impart an orbital motion to the movable jaw. Consequently, the efficiency of such devices in crushing materials is impaired. Furthermore, such crushers often utilize mechanical links either for supporting the movable jaw or as part of the drive mechanism. Due to the unusually high stresses associated with rock crushing operations, mechanical links of this type are subject to wear and breakage. When this occurs, the crusher is often inoperative for a substantial period of time, at great cost and lost productivity, while repairs are made.

In another known type crusher, as exemplified by U.S. Pat. Nos. 2,177,524 and 2,487,744, a complex revolving cam drive assembly slides against friction or wear pads during at least a portion of rotation of the cam. During each revolution of the cam, a portion of the motion of the cam, usually a portion of the vertical component of its motion, is not transferred to the movable jaw. In addition to frequent time consuming replacement of worn out friction pads, more energy is required to drive such devices to overcome the friction between the drive mechanism and the pads.

Still another form of rock crusher is illustrated in U.S. Pat. No. 3,145,938. The drive mechanism of this prior art device includes an eccentric positioned toward the top of a movable jaw. A mechanical link coupled between the framework of the crusher and a lower portion of the jaw slides relative to a pin on the jaw. Because of this sliding motion, a portion of the vertical component of motion that would be otherwise imparted to the jaw by the eccentric is lost. Although the lower portion of the movable jaw of this device apparently moves back and forth along a line approximately 45° from horizontal, the motion of the upper and mid portions of the jaw is orbital as in other prior art crushers. Also, such a crusher suffers from the disadvantages associated with devices having mechanical links in that these links are subject to failure. Furthermore, sliding mechanical links of this type tend to rapidly wear, particularly when grit produced during crushing lodges between the sliding link and pin.

U.S. Pat. No. 2,505,132 discloses still another rock crusher utilizing an eccentric cam type drive mechanism. This device utilizes a link 28 to transmit motion from the drive mechanism to the movable jaw and hence suffers from the drawbacks mentioned above.

Therefore, a need exists for a relatively trouble free and mechanically simple rock crusher having a drive mechanism capable of imparting substantially linear motion to a movable jaw between a pair of fixed jaws.

SUMMARY OF THE INVENTION

The present invention overcomes the foregoing problems by providing at least one rotary eccentric drive mechanism in a crusher. More specifically, such a drive mechanism passes through a circular yoke in the movable jaw and includes a driven eccentric cam shaft which cooperates with an eccentric for imparting substantially linear motion, as opposed to orbital motion, to the jaw. As a more specific feature of one embodiment of the invention, the eccentric comprises an eccentric sleeve or bushing surrounding the cam shaft.

As another feature of one embodiment of the invention, the upper portion of the movable jaw is supported by a pivot shaft while one such drive mechanism is positioned to drive a lower portion of the movable jaw.

As a feature of another embodiment of the invention, a pair of such drive mechanisms cooperate to impart substantially linear motion to the entire movable jaw.

A primary object of the invention is to provide a rock crusher having an improved drive mechanism.

Another object of the invention is to provide a rock crusher with an improved drive mechanism which imparts substantially linear motion to a movable jaw between a pair of fixed jaws.

A further object of the invention is to provide a rock crusher with such a drive mechanism which is durable and easy to maintain.

Still another object of the invention is to provide a relatively low cost and mechanically simple drive mechanism for a rock crusher.

An additional object is to provide an improved rock crusher which minimizes the number of moving parts.

The foregoing and other objects, features and advantages of the present invention will become more apparent from the following detailed description, which proceeds with reference to the accompanying drawings.

DETAILED DESCRIPTION OF THE PREFERRED EMBODIMENTS

Figure 1:
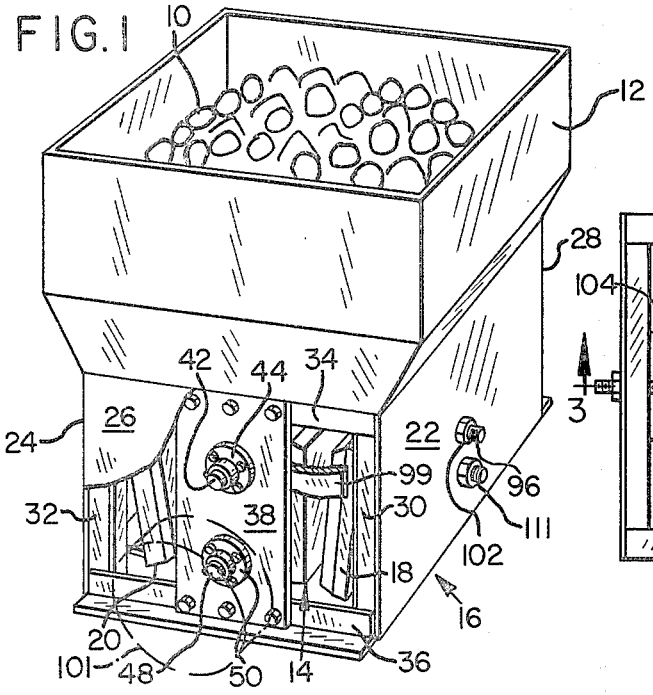
FIG. 1 is a partially broken away front perspective view of a rock crushing apparatus in accordance with the present invention.
Figure 2:
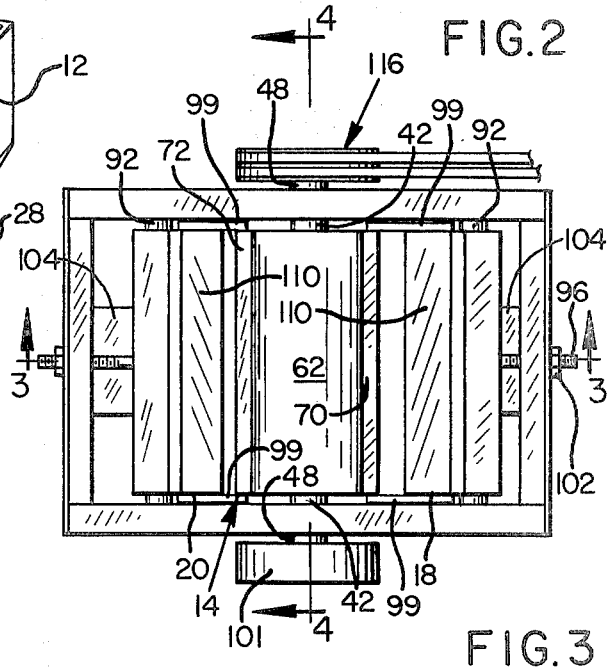
FIG. 2 is a top view of the invention of FIG. 1 with the hopper portion thereof removed for clarity.

Referring to FIGS. 1 and 2, rocks 10 are deposited by an endless conveyor (not shown) into an upwardly opening hopper 12 of a rock crusher in accordance with the invention. A movable jaw 14 supported by a rigid box-like frame 16 is positioned beneath hopper 12 so that rocks falling from the hopper pass between the sides of jaw 14 and a pair of respective stationary jaws 18, 20. A drive mechanism, explained below, causes jaw 14 to reciprocate in a substantially linear direction between the stationary jaws to thereby crush the rock. The crushed rock exits from the bottom of frame 16.

Hopper 12 is mounted to the upper end of frame 16 which has side wall panels 22, 24 and front and rear wall panels 26, 28. Frame 16 is preferably of steel or other strong durable material. The frame includes suitable reinforcing members, such as side wall I-beams 30, 32 and respective upper and lower angle beams 34, 36 adjacent the front and rear wall panels 26, 28 of the crusher.

Frame 16 also includes a rigid upright jaw supporting plate 38 secured at its upper end to beam 34 and at its lower end to beam 36 adjacent front wall panel 26. A similar plate 40 (shown in FIG. 3) extends between beams 34, 36 adjacent rear wall panel 28.

An upper pivot shaft 42 (shown in FIG. 4) extends transversely between plates 38, 40 and is journalled at its respective ends to these plates by roller bearings 44 each retained within a bearing housing 45 secured to respective plates 38, 40. An annular extension 46 of the inner race of each bearing 44 passes outwardly through an opening in its respective bearing housing 45 and is secured to the shaft 42 by set screws 47. As a result, axial sliding movement of shaft 42 is prevented. A drive pivot shaft 48 extends transversely between plates 38, 40 below shaft 42. Shaft 48 is similarly journalled at its ends to upright plates 38, 40 by roller bearings 50 in respective bearing housings 51. Set screws 53 secure annular extensions 55 of the inner race of bearings 50 to shaft 48 so that axial sliding of shaft 48 is eliminated.

JAWS

Figure 3:
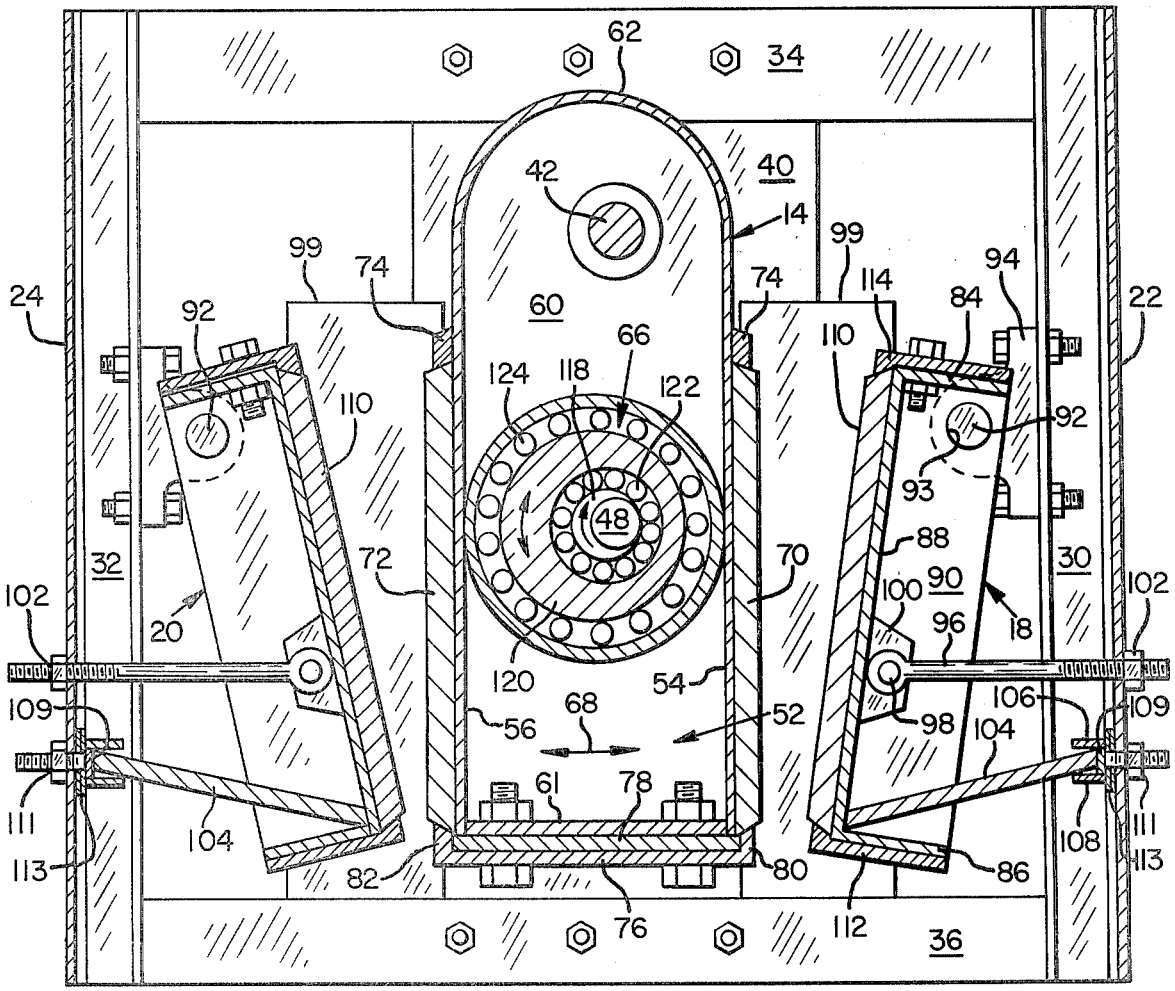
FIG. 3 is a vertical sectional view of the apparatus of the present invention taken along lines 3—3 of FIG. 2.
Figure 4:
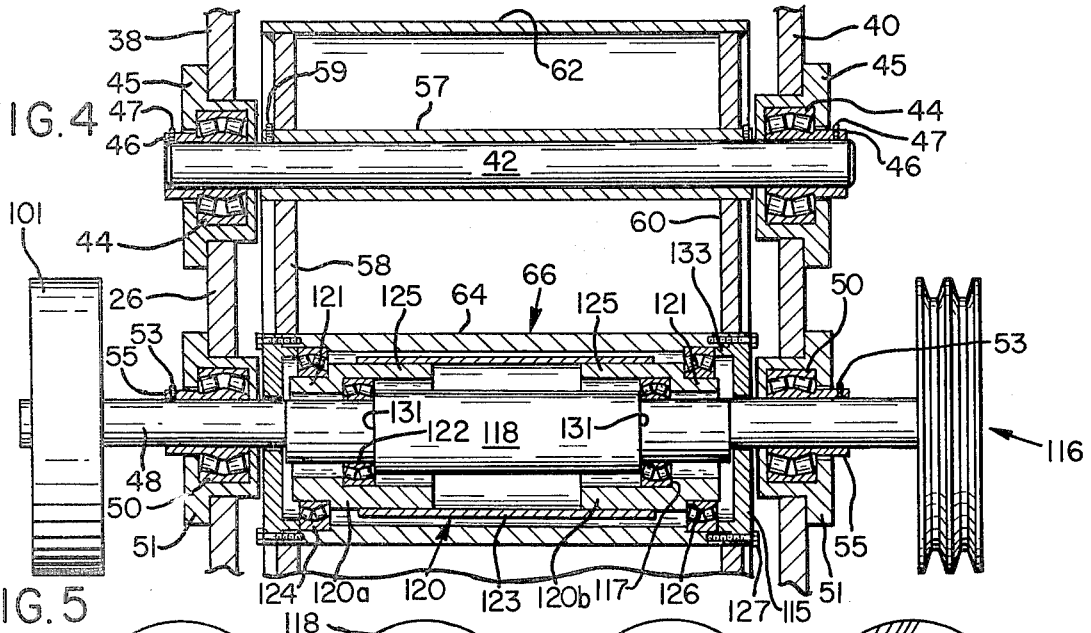
FIG. 4 is a vertical sectional view of the apparatus of the invention taken along lines 4—4 of FIG. 2.

With reference to FIGS. 2, 3 and 4, movable jaw 14 is generally upright and is suspended by shaft 42 for crushing movement between stationary jaws 18, 20. Jaw 14 includes a main body 52 having a pair of spaced-apart upright side plate portions 54, 56, which extend transversely between upright plates 38, 40, front and rear plate portions 58, 60, a bottom plate portion 61 and a cap portion 62. Cap portion 62 joins the upper ends of side plate portions 54, 56 and is of semicircular cross section to divert rock from hopper 12 downwardly along the sides of jaw 14.

As best seen in FIG. 4, a cylindrical sleeve 57 extends between plates 58, 60 with one end of the sleeve passing through an opening in plate 58 and the other end passing through an opening in plate 60. Sleeve 57 is secured to the outer surface of each plate as by welding. Shaft 42 is positioned within sleeve 57 and set screws 59 located adjacent the ends of the sleeve, secure the shaft to the sleeve and hence jaw 14 to the shaft. Shaft 42 is of uniform diameter so that it can be removed, by loosening screws 59, in the event of wear.

A cylindrical sleeve 64 extends between plates 58, 60 below shaft 42 and forms a circular yoke for receiving shaft 48 and the associated drive mechanism of the crusher, indicated generally as 66 in FIGS. 3 and 4. A capping plate 115 is secured by screws 127 to each end of sleeve 64. Together, sleeve 64 and capping plates 115 define a chamber for the drive mechanism. The ends of shaft 48 pass outwardly from this chamber through openings in the capping plates and extend through bearings 50 as explained above. The outer surface of each capping plate clears the interior surface of its adjacent bearing housing 50 only slightly. Consequently, capping plate 115 and bearing housings 51 cooperate to prevent axial shifting of jaw 14. The operation of drive mechanism 66 is explained below, but in general it imparts a substantially linear crushing motion to jaw 14 in the direction of arrows 68 (FIG. 3).

A pair of oppositely facing crushing plates 70, 72 are mounted to the respective side plates 54, 56 of jaw body 52. The outer surface of each of these plates constitutes a generally upright crushing surface which extends transversely between front and rear wall plates 38, 40. As well known in the art, these crushing surfaces are appropriately textured to produce the desired size of crushed material. For example, these surfaces may be smooth to produce finer rock. Crushing plates 70, 72 are releasably secured to side plates 54, 56 as follows. An undercut retaining bar 74 is mounted to the outer surface of each plate 54, 56. These retaining bars 74 are positioned at the location desired for the upper ends of respective crushing plates 70, 72, which in turn are each beveled to wedge tightly against the lower surface of its respective retaining bar. An upwardly opening generally U-shaped keeper plate 76 is fastened to bottom plate 61. The upper end of each leg 80, 82 of keeper plate 76 is undercut to retain the correspondingly beveled lower edges of crushing plates 70, 72 rigidly in place when keeper plate 76 is in position. Removal of the crushing plates can easily be accomplished by loosening the bolts holding keeper plate 76 in place. This facilitates their rapid replacement when they become worn.

Each stationary jaw 18, 20 is identical so that only jaw 18 will be described. Jaw 18 includes a rigid rectangular frame comprised of a top plate 84, bottom plate 86, face plate 88, and a pair of side plates 90 (one shown in FIG. 3). Jaw 18 is supported by a pivot pin 92 which passes through openings 93 in side plates 90. Pin 92 is connected at one end by a mounting bracket 94 to the web of rearmost I-beam 30 and at its other end by a similar bracket to the web of forwardmost I-beam 30. Inward motion of jaw 18 toward jaw 14 is limited by an eye bolt 96. Bolt 96 is pivoted at one end 98 to a bracket 100 projecting from face plate 88 and its other end is slidable through an opening in side panel 22. A nut 102 is secured to this other end exteriorly of panel 22 and limits the inward sliding of bolt 96 to thereby limit inward motion of jaw 18.

An overload relieving toggle plate 104 has one end loosely retained between a pair of spaced apart generally horizontal flanges 106, 108 projecting interiorly from a base plate 109 fastened by bolts 111 to I-beam 30. The other end of the toggle plate abuts the lower end of face plate 88. Addition of shims, such as 113, between base plate 109 and I-beam 30 reduces the distance between the lower end of stationary jaw 18 and movable jaw 14 so that finer crushed rock is produced. Conversely, removal of the shims increases this distance thereby causing the production of coarser rock.

Preferably, the toggle plates are designed to break in the event pressure between the jaws exceeds a predetermined upper limit, such as when uncrushable material becomes lodged between the jaws. For example, the toggle plates may be of a brittle material such as cast iron. Breakage of the respective toggle plates enables the associated stationary jaw to pivot away from the movable jaw. As a result, material caught between the jaws is released before the crusher is damaged.

A wear plate 110, similar in shape to crushing plate 70, is secured to facing plate 88 in much the same manner as the crushing plate is secured to side plate 54. That is, wear plate 110 is wedged between an undercut retaining plate 112 secured to bottom plate 86 and an undercut keeper plate 114 releasably mounted to upper plate 84. Wear plate 110 provides a stationary crushing surface which may be textured in a conventional manner.

Thus, the wear plate 110 of each stationary jaw is disposed transversely between upright front and rear plates 38, 40 in opposed, spaced relation to substantially the entire expanse of an associated one of said crushing plates 70, 72. Each pair of opposed stationary and movable crushing surfaces converge downwardly in order to define, together with removable wear plates 99 (best seen in FIG. 3) mounted to the walls of the frame, a crushing cavity at each side of the movable jaw.

Drive mechanism 66, shown in FIGS. 3 and 4 is designed to impart substantially linear motion to movable jaw 14 between stationary jaws 18, 20.

More specifically, shaft 48 is driven in rotation, such as by a prime mover coupled to the shaft by a belt drive assembly 116 shown in FIG. 2, to in turn drive an eccentric or cam 118 mounted to the shaft 48. A balance or fly wheel 101 is mounted to the end of shaft 42 opposite drive assembly 116 to balance the drive assembly. Cam 118 in turn tends to impart gyratory motion to jaw 14.

An eccentric means cooperates with cam 118 to provide the desired motion of the movable jaw. Although the eccentric means can take many forms, for example it may comprise a crescent shaped member disposed between sleeve 64 and cam 118, it preferably comprises a cylindrical eccentric bushing 120 which at least partially surrounds cam 118. Bushing 120 oscillates about its axis as cam 118 rotates to substantially take up the vertical component of motion of cam 118 so that it is not transferred to the movable jaw. Thus, jaw 14 moves along a path indicated by arrows 68. Of course, jaw 14 does move in a slight arc about the axis of pivot shaft 42, but its motion is substantially linear, and, in the illustrated embodiment, the motion is generally horizontal.

Eccentric bushing 120 may be of one piece construction, but is preferably of composite construction to facilitate manufacturing of the device and includes a pair of primary eccentric bushing portions 120*a*, 120*b* and a connecting sleeve which joins bushing portions 120*a*, 120*b* together. Each primary bushing portion 120*a*, 120*b* is identical and comprises a cylindrical sleeve with a first cylindrical section 121 of reduced outside diameter and a second cylindrical section 125 of reduced inside diameter. An annular shoulder 126 is provided at the exterior transition between the first and second sections and a similar annular shoulder 117 is provided at the interior transition. Bushing portions 120*a*, 120*b* are oriented with their first sections adjacent the respective cap plates 115. Also, the second section of bushing portion 120*a* is received within and secured to one end of sleeve 123 while the second section of bushing portion 120*b* is received with and secured to the other end of sleeve 123. Consequently, eccentric bushing portions 120*a*, 120*b* oscillate in unison. Eccentric bushing 120 is mechanically coupled to sleeve 64 by a pair of roller bearings 124 to facilitate the free oscillation of the eccentric relative to the sleeve. Outward movement of each bearing 124 is prevented by an inwardly projecting annular ring 133 of end caps 115. Inward movement of bearings 124 is prevented by shoulder 126 of bushing portions 120*a*, 120*b* respectively. In addition, the eccentric bushing 120 is journalled to cam 118 by a pair of roller bearings 122 each positioned within the drive assembly chamber adjacent to a respective one of the cap plates 115. The inner race of each bearing 122 is seated on a bearing seat of cam 118 of reduced diameter. An annular shoulder 131 bounding the reduced diameter portion of cam 118 abuts the interior side of the inner race of bearing 122. Consequently, inward sliding movement of bearing 122 along the axis of cam 118 is prevented. The outer race of each bearing 122 abuts a portion of the second section 125 of its respective eccentric bushing portion with its outer side abutting shoulder 117 to prevent outward sliding of the bearing.

With such a construction, cam 118 is continuously and positively coupled by eccentric bushing 120 and the associated roller bearings to sleeve 64 and hence to the movable jaw.

Although other alignments are suitable, in the form illustrated in FIGS. 1–4, the axes of shafts 42 and 48 are in a common vertical plane. Furthermore, in its starting position, the widest portion of cam 118 is positioned on the same horizontal line and adjacent to the widest portion of eccentric bushing 120.

Figure 8:
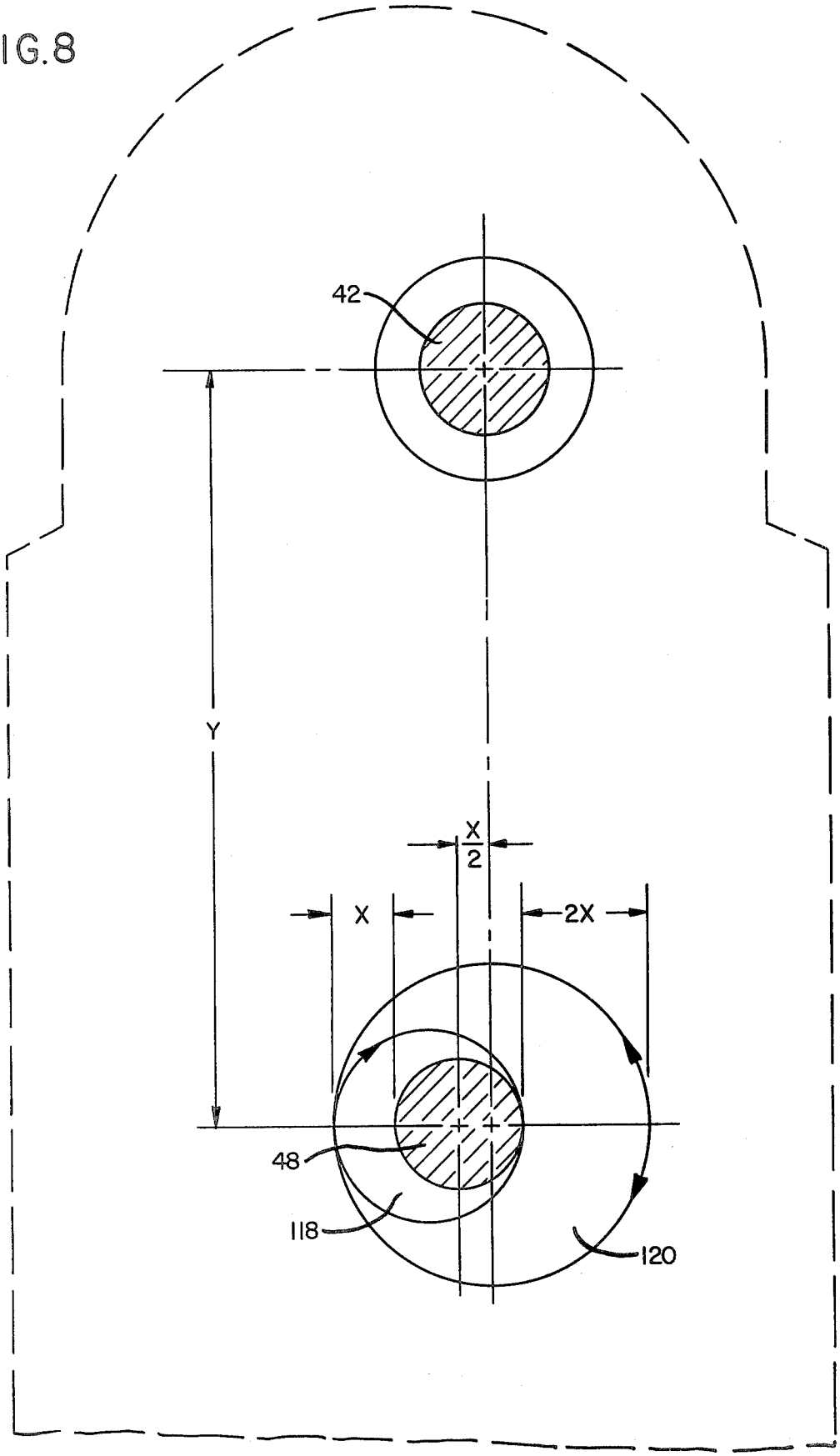
FIG. 8 is a schematic diagram of one preferred arrangement of shafts and eccentrics of the drive mechanism of FIG. 3.

Another preferred alignment is shown in FIG. 8 in which Y is the vertical distance between the axes of shafts 42 and 48 and X is the maximum eccentricity of cam 118. Instead of being in a common vertical plane, the axis of shaft 48 is shifted along a horizontal line a distance equal to one-half the maximum eccentricity of cam 118 from a vertical plane containing the axis of shaft 42. In addition, the maximum eccentricity of eccentric bushing 120 is 2X. In its starting position shown in FIG. 8, the maximum eccentricity of eccentric bushing 120 and of cam 118 are in a common horizontal plane, but are on opposite sides of the axis of shaft 48. With this arrangement, the movable jaw moves an equal distance on each side of the vertical plane through the axis of shaft 42. Thus, the throw of the jaw on each side of this plane is the same.

DESCRIPTION OF SECOND PREFERRED EMBODIMENT

Figure 6:
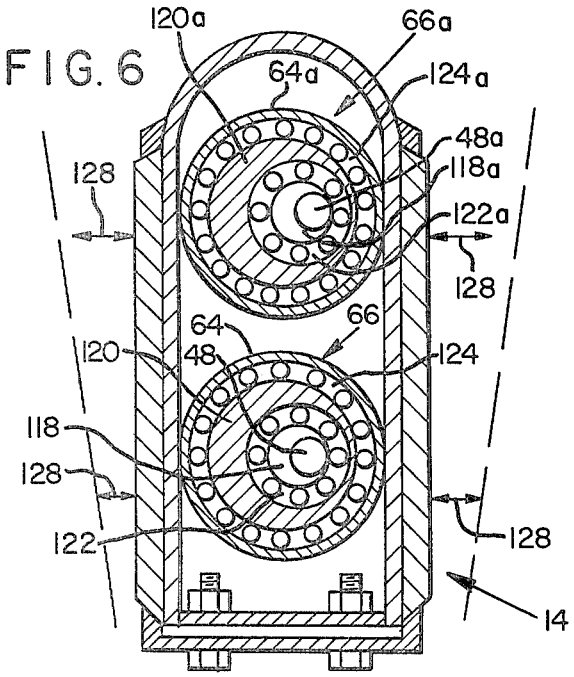
FIG. 6 is a vertical sectional view of another embodiment of the present invention employing a pair of drive mechanisms of the type shown in FIG. 3.
Figure 7:
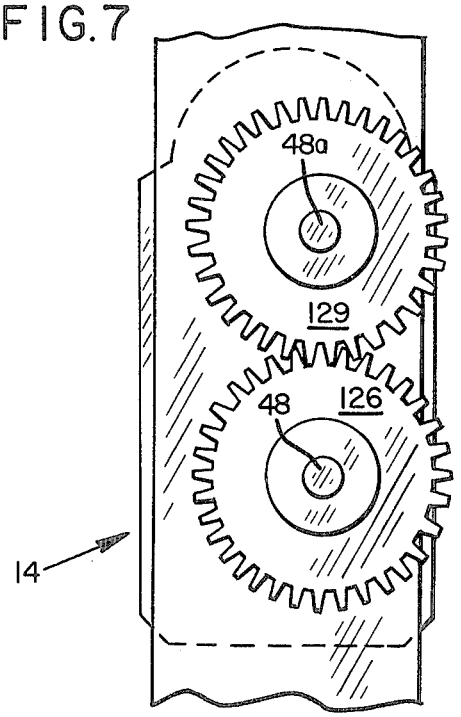
FIG. 7 is a front elevational view of a portion of the rock crusher of FIG. 6.

Looking at FIGS. 6 and 7, a second embodiment of the invention is illustrated. This embodiment is identical with the previously described FIG. 1 embodiment except that a second drive mechanism 66*a* is substituted in place of the fixed shaft 42 of FIG. 3.

In this latter embodiment, shaft 48 is driven as explained above. In addition, a gear 126 mounted to shaft 48 at the front of the crusher engages a similar gear 129 connected to shaft 48*a*. Consequently, shafts 48 and 48*a* rotate together to produce the desired crushing motion. Also, at the opposite end of the crusher, a gear (not shown) mounted to eccentric bushing 120 engages a similar gear (not shown) mounted to eccentric bushing 120*a* so that the two lost motion eccentrics oscillate together.

With this dual eccentric drive arrangement, both the upper and lower portions of movable jaw 14 move in a substantially linear direction between the stationary jaws, and more specifically in the horizontal direction shown by arrows 128.

OPERATION OF DRIVE MECHANISM

Figure 5:
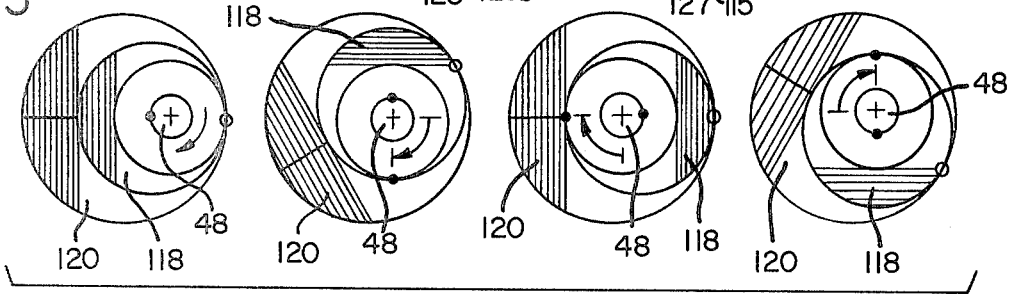
FIG. 5 is a schematic diagram of the operation of a drive mechanism in accordance with the present invention.

Referring to FIG. 5, the operation of drive mechanism 66 will be explained in greater detail. From its starting position shown to the far left in FIG. 5, rotation of shaft 48 clockwise through ninety degrees moves cam 118 clockwise (upwardly) ninety degrees. At the same time, the eccentric bushing moves counterclockwise to thereby compensate for the upward motion of cam 118 during the first 90 degree rotation. Rotation of cam 118 through an additional 90 degrees causes the eccentric bushing to return to its initial position. Further rotation of cam 118 (downwardly) through 90 degrees causes clockwise movement (upward) of eccentric bushing 120 to compensate for the downward motion of cam 118. Additional rotation of cam 118 through 90 degrees returns the drive mechanism to its starting position.

It should be noted that many variations of my invention are possible, but all include at least one rotary eccentric drive assembly, such as assembly 66. For example, pivot shaft 42 can be positioned below drive assembly 66 in the embodiment of FIGS. 1–4. Also, the bearings in the rotary eccentric drive assembly can be arranged in different positions. For example, eccentric bushing 120 can be modified so that bearings 122, 124 are in a common vertical plane, or so that bearings 122 are closer to end caps 115 than bearings 124. In addition, if X is the maximum eccentricity of cam 118, the maximum eccentricity of the eccentric bushing need not equal 2X, but is greater than X for operation of the drive mechanism. Furthermore, the invention is of course not limited to the illustrated form of roller bearings, for example, bronze bushings or other forms of roller bearings may be used.

Having illustrated and described the principals of my invention with reference to several preferred embodiments, it should be apparent to those persons skilled in the art that such invention may be modified in arrangement and detail without departing from such principals. I claim as my invention all such modifications as come within the true spirit and scope of the following claims.

I claim:

1. A drive mechanism for reciprocating a movable jaw of a rock crusher in a substantially linear direction toward and away from a stationary jaw of the crusher comprising:

rotatable cam shaft means coupled to said movable jaw;

eccentric means movable relative to said cam shaft means and relative to said movable jaw for taking up motion of said cam shaft means such that said movable jaw reciprocates substantially in said one direction when said cam shaft means rotates.

2. A drive mechanism according to claim 1 in which said eccentric means surrounds at least a portion of said cam shaft means.

3. A drive mechanism according to claim 2 in which said eccentric means is journalled to the surrounded portion of said cam shaft means and is surrounded at least partially by a portion of the movable jaw.

4. A drive mechanism for reciprocating a movable jaw of a rock crusher in a substantially linear direction toward and away from a stationary jaw of the crusher comprising:

rotatable cam shaft means coupled to said movable jaw; and eccentric bushing means mounted to said cam shaft means for oscillatory movement relative to both said movable jaw and said cam shaft means so as to take up motion of said cam shaft means.

5. A rock crusher comprising:

a frame, said frame including a pair of upright spaced apart frame walls;

at least one stationary jaw extending transversely between said frame walls;

a generally upright movable jaw suspended between said upright frame walls for reciprocating movement toward and away from said stationary jaw, said movable jaw including a first cylindrical wall portion which defines a first chamber of circular cross section extending at least partially through the movable jaw along a transverse axis between the frame walls; and drive means for reciprocating said movable jaw in a substantially linear direction toward and away from said stationary jaw to crush rock between the jaws, said drive means including first rotatable cam shaft means positioned at least partially within said first chamber and first eccentric means mechanically coupled to said first cam shaft means for motion relative to said cam shaft means and cooperating with said cam shaft means to impart reciprocating motion to said movable jaw substantially in said linear direction when said first cam shaft means rotates.

6. A rock crusher according to claim 5 including means for pivoting an upper portion of said movable jaw to said frame walls for pivoting movement about a generally horizontal pivot axis extending transversely between said walls, the axis of the chamber being positioned below and generally parallel to said pivot axis such that said drive means causes a lower portion of said movable jaw to move substantially in said linear direction and about said pivot axis.

7. A rock crusher according to claim 5 in which said first chamber extends through said movable jaw, said cam shaft means including a drive shaft portion extending through said chamber and pivoted at one end portion to one of said frame walls and at the other end portion to the other of said frame walls, said cam shaft means also including a camming portion positioned within said chamber and projecting from said drive shaft so as to rotate about the axis of said drive shaft with the rotation of said drive shaft, and in which said eccentric means comprises a hollow cylindrical eccentric bushing surrounding said camming portion with its interior surface mechanically coupled to said camming portion and its exterior surface mechanically coupled to said first cylindrical wall portion such that said bushing is free to oscillate relative to both said camming portion and said first cylindrical wall portion.

8. A rock crusher according to claim 7 including means for pivoting an upper portion of said movable jaw to said frame walls for pivoting movement about a generally horizontal pivot axis extending transversely between said walls, the axis of the chamber being positioned below and generally parallel to said pivot axis such that said drive means causes a lower portion of said movable jaw to move substantially in said linear direction and about said pivot axis, and in which said pivot axis and the axis of said drive shaft are in a common vertical plane.

9. A rock crusher according to claim 8 in which X is the width of the maximum eccentricity of said camming portion and 2X is the width of the maximum eccentricity of said eccentric bushing, and the axis of said drive shaft is shifted horizontally a distance of ½X from a vertical plane containing said pivot axis, and when said drive means is in at least one position the maximum eccentricity of said eccentric bushing is positioned in a horizontal plane passing through the axis of said drive shaft and is located on the side of the vertical plane containing said pivot axis which is opposite the side on which the axis of said drive shaft is located, whereby said movable jaw has an equal throw to each side of said vertical plane.

10. A rock crusher according to claim 9 including means for rotating said drive shaft and flywheel means mounted to said drive shaft for balancing the rotation of said drive shaft about its axis.

11. A rock crusher comprising:

a frame, said frame including a pair of upright spaced apart frame walls;

a generally upright movable jaw suspended between said upright frame walls for reciprocating movement toward and away from said stationary jaw, said movable jaw including a first cylindrical wall portion which defines a first chamber of circular cross section extending at least partially through the movable jaw along a transverse axis between the frame walls; and drive means for reciprocating said movable jaw in a substantially linear direction toward and away from said stationary jaw to crush rock between the jaws, said drive means including first rotatable cam shaft means positioned at least partially within said first chamber and first eccentric means mechanically coupled between said first cam shaft means and said first cylindrical wall portion such that said movable jaw reciprocates substantially in said linear direction when said first cam shaft means rotates, said first chamber being positioned in a lower portion of said movable jaw, said movable jaw also including a second cylindrical wall portion which defines a second chamber of circular cross section extending at least partially through an upper portion of the movable jaw along a transverse axis between the frame walls, said drive means including second rotatable cam shaft means positioned at least partially within said second chamber and second eccentric means mechanically coupled between said second cam shaft means and said second cylindrical wall portion such that said movable jaw reciprocates substantially in said linear direction when said second cam shaft means rotates.

12. A rock crusher according to claim 11 in which said first and second chambers extend transversely through the movable jaw, said first cam shaft means including a first drive shaft extending through said first chamber and pivoted at one end portion to one of said frame walls and pivoted at the other end portion to the other of said frame walls, said first drive shaft including a first camming portion positioned within said first chamber, and in which said first eccentric means comprises eccentric bushing means surrounding said first camming portion and adapted for oscillation relative to said first camming portion, said second cam shaft means including a second drive shaft extending through said second chamber and pivoted at one end portion to one of said frame walls and pivoted at its other end portion to the other of said frame walls, said second drive shaft including a second camming portion positioned within said second chamber, and in which said second eccentric means comprises eccentric bushing means surrounding said second camming portion and adapted for oscillation relative to said second camming portion, and also including means for rotating said first and second drive shafts to reciprocate said movable jaw.

13. A rock crusher according to claim 12 in which said means for rotating said first and second drive shafts comprises means for rotating at least one of said first and second drive shafts and means mechanically coupling said first and second drive shafts such that said first and second drive shafts rotate together.

14. A rock crusher according to claim 12 including means mechanically coupling said first and second eccentric bushing means together such that said bushing means oscillate together in unison.

15. A rock crusher comprising:

a frame, said frame including a pair of upright spaced apart frame walls;

a pair of stationary jaws extending transversely between said frame walls;

a pivot shaft extending transversely between an upper portion of said frame walls and pivoted at one end portion to one of said frame walls and at its other end portion to the other of said frame walls;

a generally upright movable jaw mounted to said pivot shaft between said frame walls for swinging movement about the axis of said shaft, said movable jaw including a cylindrical chamber defining sleeve extending transversely through said movable jaw so as to define a chamber of circular cross section having an axis which is parallel to said pivot shaft;

a drive shaft extending through said chamber and pivoted at one end portion to one of said frame walls and pivoted at its other end portion to another of said frame walls, said drive shaft including a cylindrical camming portion positioned within the chamber;

a hollow cylindrical eccentric bushing surrounding said camming portion, said eccentric bushing being mechanically coupled to the interior surface of said chamber defining sleeve and to the exterior surface of said camming portion, so as to move relative to both said cylindrical sleeve and said camming portion with the rotation of said camming portion, and such that said movable jaw moves substantially in a horizontal direction between the stationary jaws when the drive shaft is rotated.

16. A rock crusher according to claim 15 including at least two outer roller bearings positioned between said eccentric bushing and said chamber defining sleeve and at least two inner roller bearings positioned between said camming portion and said eccentric bushing, and in which said eccentric bushing includes a bushing portion at each end thereof and a connecting sleeve which secures said bushing portions together, an inner end portion of one of said bushing portions being inserted into and secured to one end of said connecting sleeve and an inner end portion of the other of said bushing portions being inserted into and secured to the other end of said connecting sleeve, an outer end portion of each said bushing portions being of reduced outside diameter and a corresponding outer end portion of each end of said chamber defining sleeve is of enlarged inside diameter so as to provide a bearing seat for each of said outer bearings, an inner end portion of each said bushing portion being of enlarged inside diameter and a corresponding portion of each end of said camming portion being of reduced outside diameter so as to provide a bearing seat for each of said inner bearings, and a cap plate for closing each end of said chamber, each said cap plate having an opening therethrough for passage of said drive shaft and having an inwardly projecting annular ring which abuts the adjacent one of said outer bearings to prevent axial outward sliding movement of the adjacent outer bearing.

17. A rock crusher according to claim 16 in which said drive shaft includes a first end portion projecting outwardly from one of said frame walls and a second end portion projecting outwardly from the other of said frame walls, said rock crusher including drive means coupled to said first end portion for rotating said drive shaft and balance means coupled to said second end portion for balancing the rotation of said drive shaft.

* * * * *